US011484104B2

(12) United States Patent
Zhang

(10) Patent No.: US 11,484,104 B2
(45) Date of Patent: Nov. 1, 2022

(54) LUGGAGE CASE FOR CHILDREN

(71) Applicant: Shenzhen COOGHI Funkids Technology Co., Ltd, Shenzhen (CN)

(72) Inventor: Jun Zhang, Shenzhen (CN)

(73) Assignee: SHENZHEN COOGHI FUNKIDS TECHNOLOGY CO., LTD, Shenzhen (CN)

( * ) Notice: Subject to any disclaimer, the term of this patent is extended or adjusted under 35 U.S.C. 154(b) by 325 days.

(21) Appl. No.: 16/920,459

(22) Filed: Jul. 3, 2020

(65) Prior Publication Data

US 2021/0177113 A1 Jun. 17, 2021

(30) Foreign Application Priority Data

Dec. 17, 2019 (CN) ..... 201922279737.2

(51) Int. Cl.
*A45C 5/14* (2006.01)
*A45C 13/06* (2006.01)
*A45C 13/26* (2006.01)

(52) U.S. Cl.
CPC ..... *A45C 5/14* (2013.01); *A45C 13/06* (2013.01); *A45C 13/262* (2013.01)

(58) Field of Classification Search
CPC ..... A45C 5/14; A45C 13/06; A45C 13/262
See application file for complete search history.

(56) References Cited

U.S. PATENT DOCUMENTS 4,762,211 A * 8/1988 Krenzel ..... A45C 3/001 190/122
5,407,218 A * 4/1995 Jackson ..... B60B 37/10 280/30
5,529,156 A * 6/1996 Yang ..... A45C 3/001 190/122
5,924,533 A * 7/1999 Cnockaert ..... E05B 65/5276 190/115
8,201,672 B2 * 6/2012 Yang ..... A45C 13/20 16/33
8,678,227 B2 * 3/2014 Patstone ..... B65D 25/24 248/692
10,039,356 B1 * 8/2018 Chen ..... A45C 5/14
10,973,291 B2 * 4/2021 Holmgren ..... A47C 17/82

* cited by examiner

*Primary Examiner* — Tri M Mai

(57) ABSTRACT

A luggage case for children includes a case body and a case lid portion installed on the case body, wherein the case body is provided with a first and second case board, a fixing member, a support column, a magnetic buckle, a drawstring set, a wire rope, a rivet and a metal ring fixedly connected to the wire rope, the first and second case board fixedly connected to the fixing member through the rivet, the rivet fixedly connecting the support column to the first and second case board, the magnetic buckle provided with a base fixedly installed on the first case board and a drawstring buckle, the second box board provided with a clamping slot, and the drawstring set fixedly installed in the clamping slot, wherein when the metal ring is engaged with the drawstring buckle, the luggage case is capable of being towed or shoulder-carried by the wire cord.

8 Claims, 8 Drawing Sheets

LUGGAGE CASE FOR CHILDREN

CROSS REFERENCE TO RELATED APPLICATION

This application claims priority to Chinese Patent Application No. 201922279737.2, filed on Dec. 17, 2019, which is hereby incorporated by reference herein as if set forth in its entirety.

BACKGROUND

Technical Field

The present disclosure generally relates to technical field of luggage case, and particularly to a luggage case for children.

Description of Related Art

The luggage case for children, which can contain children's toys, clothing and other luggage, is a kind of travel tool that parents need when they travel with children. However, there is currently no luggage case specially designed for children. Generally, travelers should carry luggage case that can be towed on the ground, but for those who also take children, it is very inconvenient to drag luggage while carrying children, and the function of the luggage case is single.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
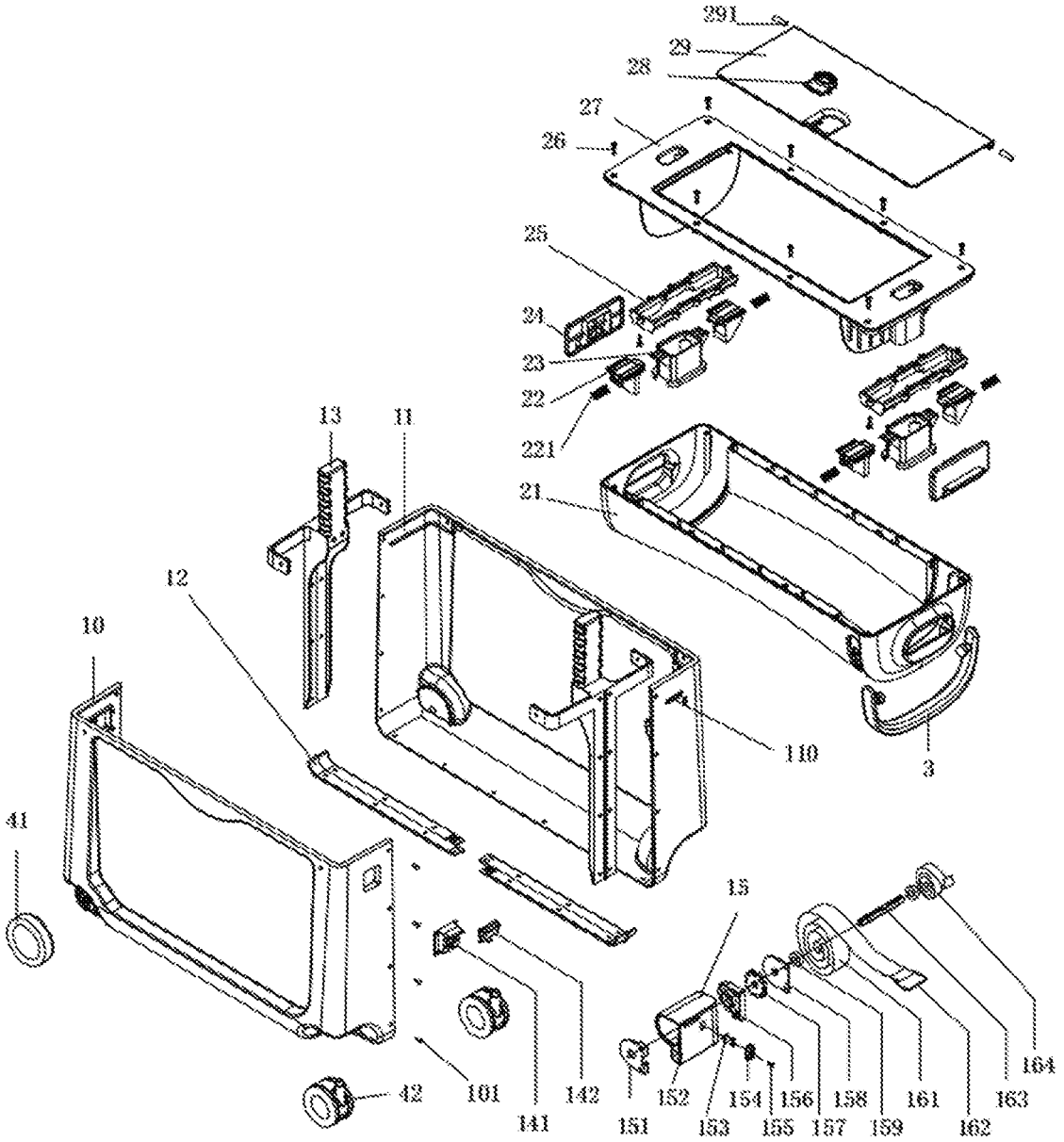
FIG. 1 is an isometric view of a luggage case for children according to an embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Figure 2:
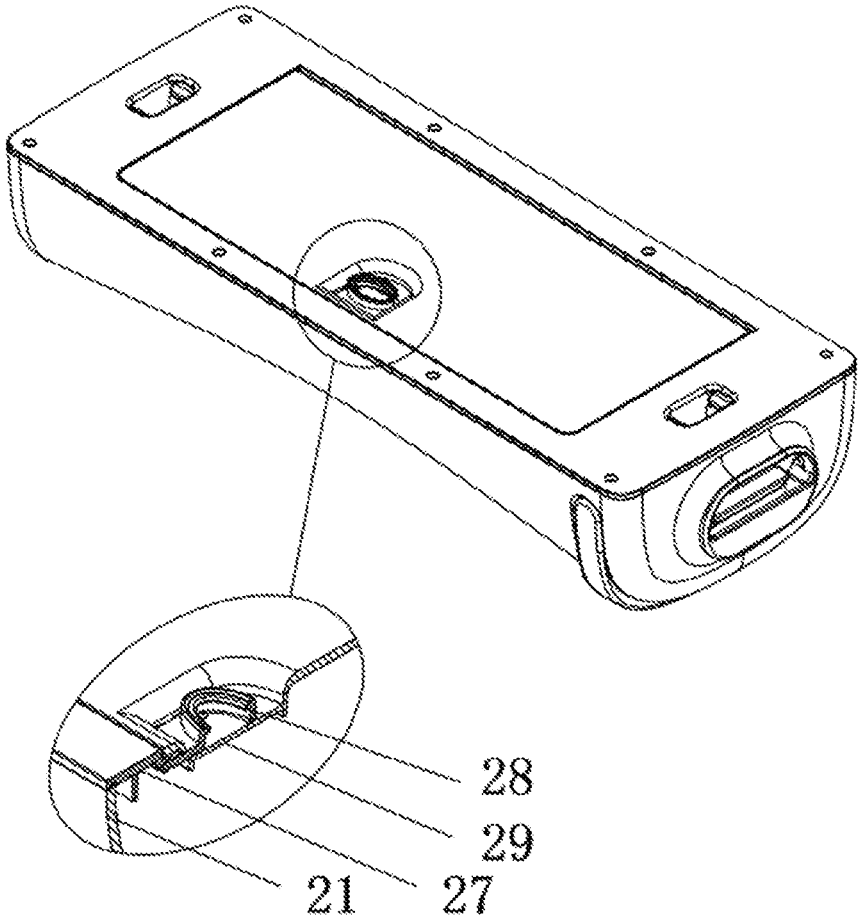
FIG. 2 is a scheme view of the case lid portion of a luggage case for children according to an embodiment.
Figure 3:
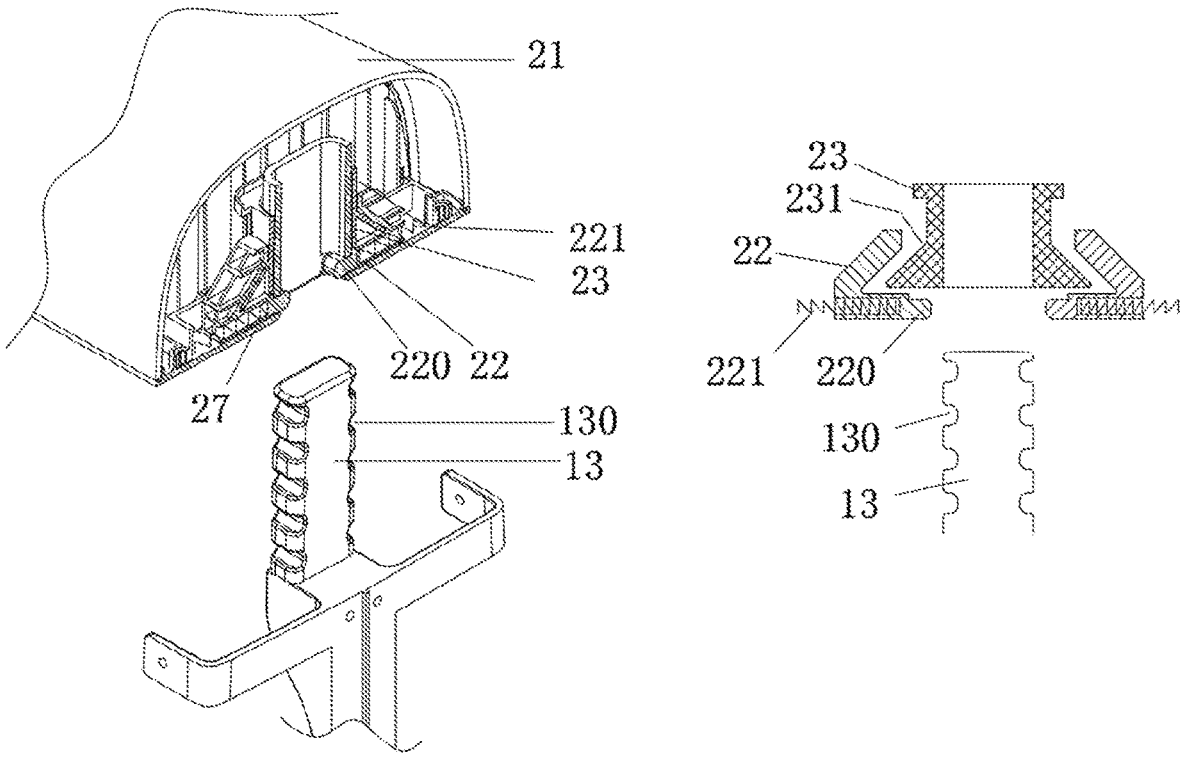
FIG. 3 is schematic view of the partial structure of the case lid portion of a luggage case for children according to an embodiment.
Figure 4:
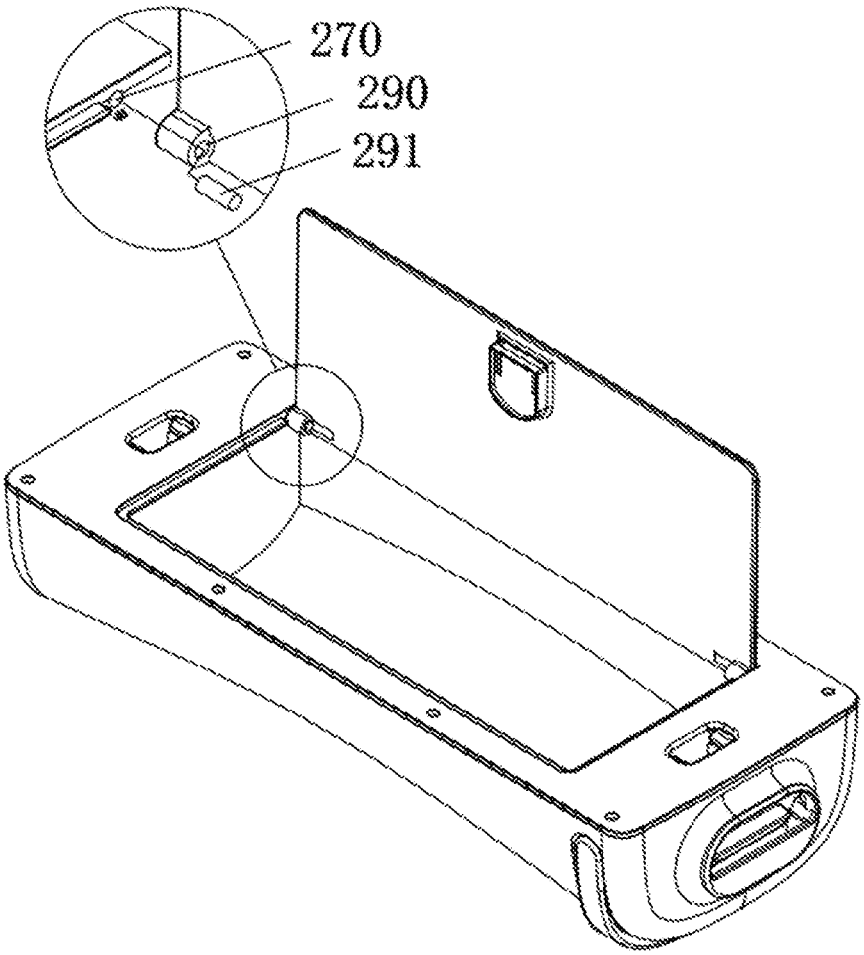
FIG. 4 is a schematic view of the case lid portion of a luggage case for children according to an embodiment.
Figure 5:
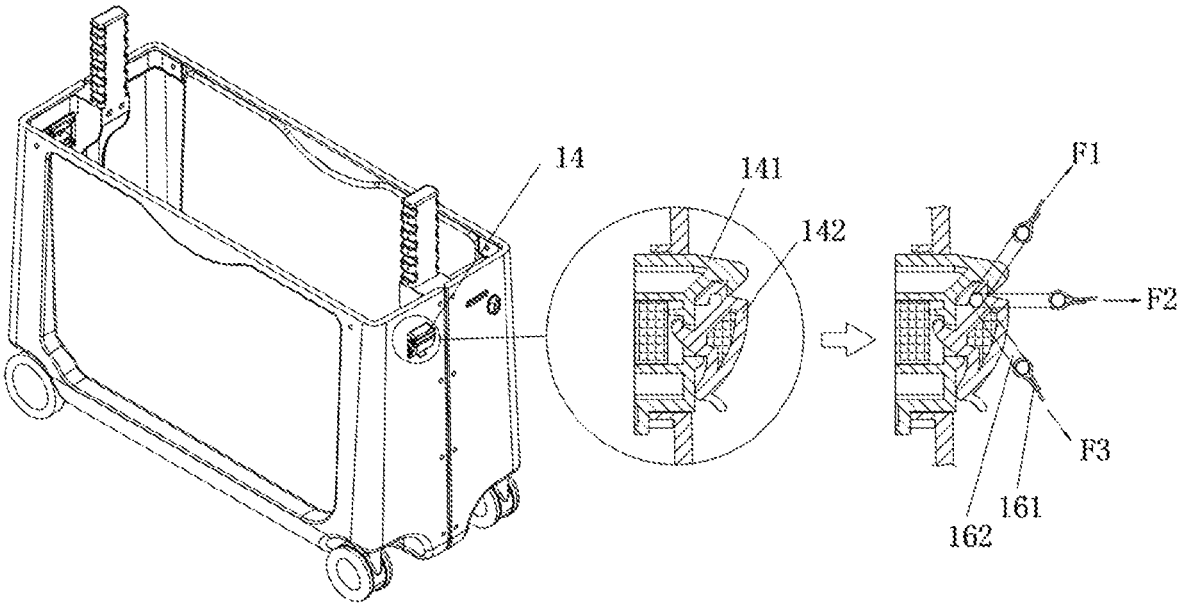
FIG. 5 is a schematic view of the magnetic buckle of a luggage case for children according to an embodiment.
Figure 6:
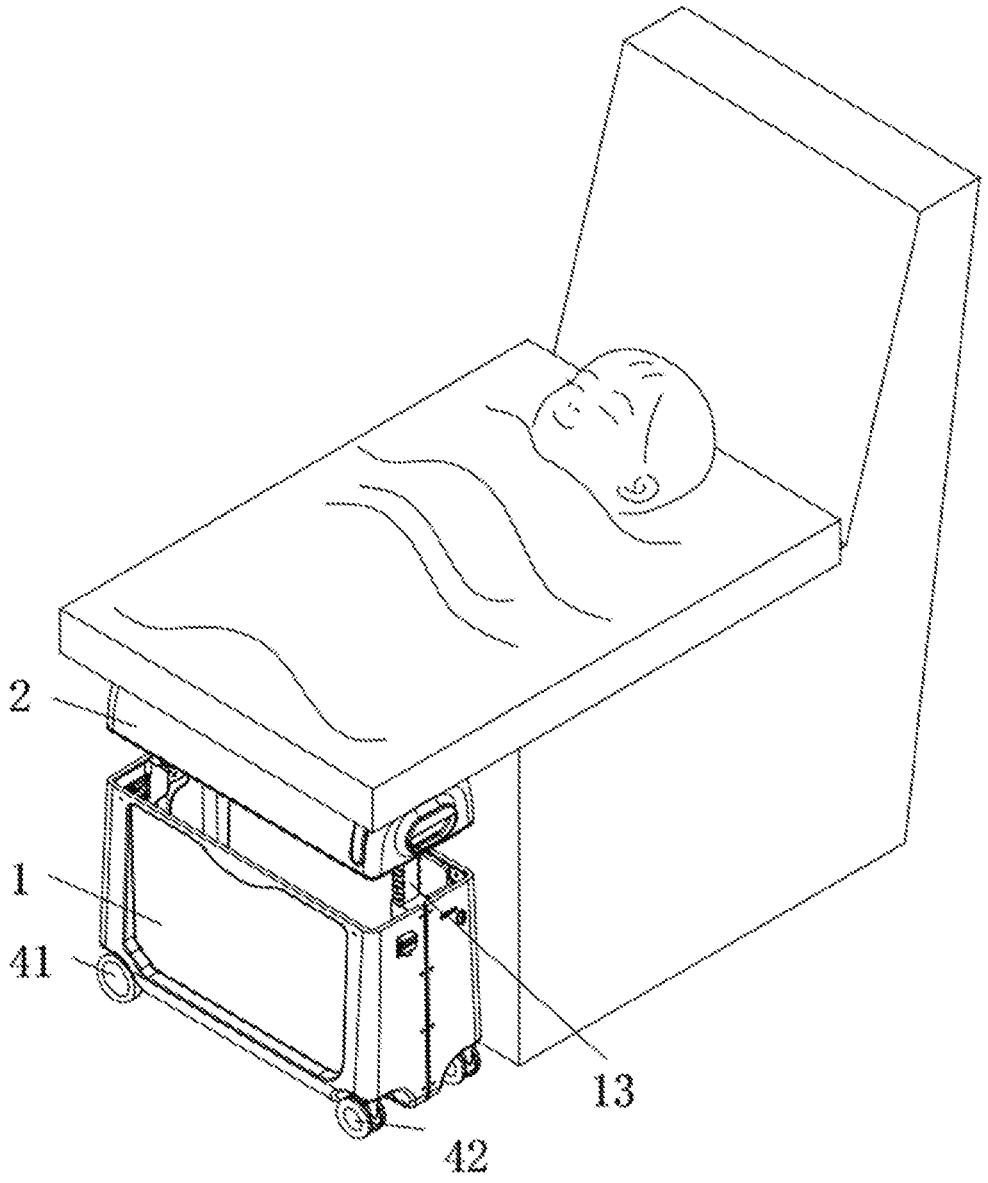
FIG. 6 is a reference view of the first state in use of the luggage case for children according to an embodiment.
Figure 7:
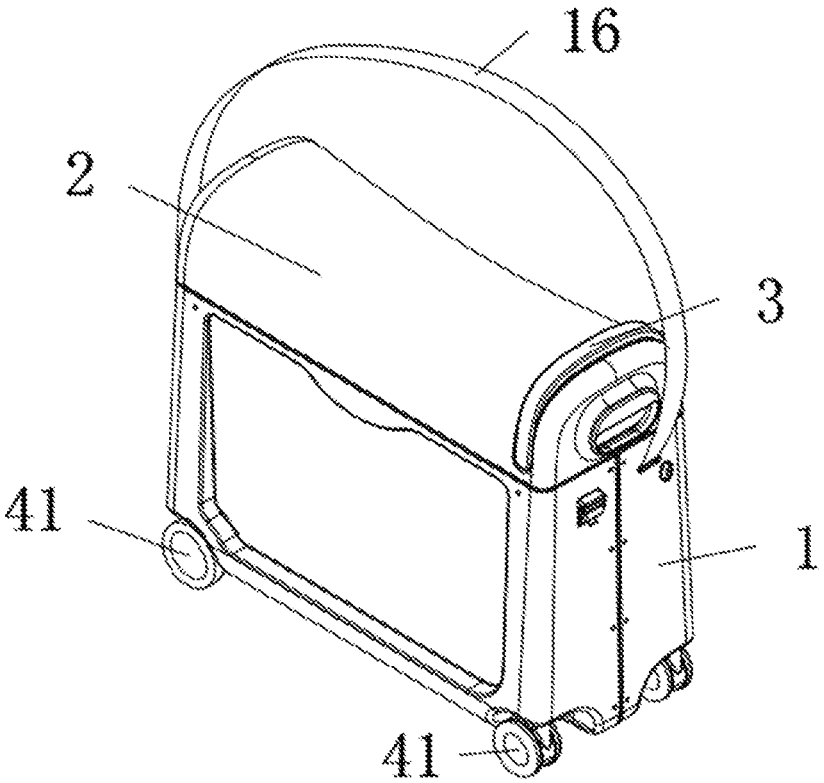
FIG. 7 is a reference view of the second state in use of the luggage case for children according to an embodiment.
Figure 8:
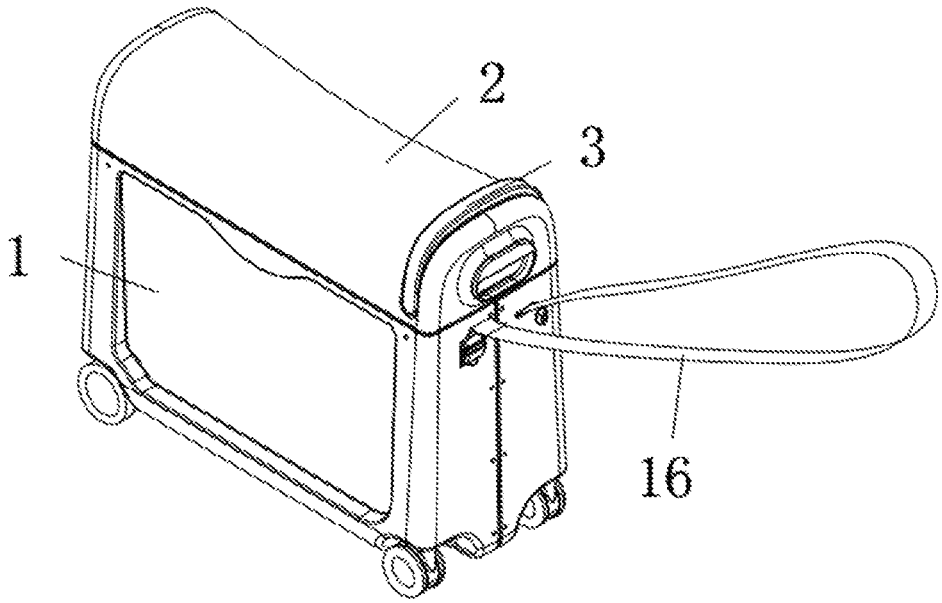
FIG. 8 is a reference view of the third use state in use of the luggage case for children according to an embodiment.

Referring to FIGS. 1-8, the present disclosure provides a luggage case for children, which includes a case body 1 and a case lid portion 2. The case lid portion 2 is installed on the case body 1. The case body 1 is provided with a first case board 10, a second case board 11, a fixing member 12, a support column 13, a magnetic buckle 14, a drawstring set 15, a wire rope 16, a rivet 101 and a metal ring 162. The first case board 10 is fixedly connected to the fixing member 12 through the rivet 101, and the second case board 11 is fixedly connected to the fixing member 12 through the rivet 101. The rivet 101 fixedly connects the support column 13 to the first case board 10, and the rivet 101 fixedly connects the support column 13 to the second case board 11. The magnetic buckle 14 is provided with a base 141 and a drawstring buckle 142, and the base 141 is fixedly installed on the first case board 10. The wire cord 16 is fixedly connected to the metal ring 162. When the metal ring 162 is engaged with the drawstring buckle 142, the luggage case for children is capable of being towed or shoulder-carried by the wire cord 16. The second box board 11 is provided with a clamping slot 110, and the drawstring set 15 is fixedly installed in the clamping slot 110.

In this embodiment, the metal ring 162 is caught in the drawstring buckle 142, and the metal ring 162 can rotate in the drawstring buckle 142. When the wire cord 16 is pulled from different angles such as F1, F2, F3, etc., the drawstring buckle 142 will be firmly buckled on the base 141, and at this time, the luggage case for children can be towed or shoulder-carried by the wire cord 16.

Further, the drawstring set 15 is provided with a box bracket 151, a box body 152, a button base 153, a button 154, a box board 156, a gear 157, a box cover 158, a bearing 159, a first rotating shaft 163 and a winder 164. The first rotating shaft 163 is fixedly connected to the winder 164, and the first rotating shaft 163 is fixedly connected to the wire cord 16. The bearing 159 is fixedly installed at both ends of the first rotating shaft 163. The box bracket 151 is fixedly connected to the box body 152. The gear 157 is fixedly installed on the first rotating shaft 163. The box board 156 is fixedly connected to the box body 152, and the box board 156 and the box bracket 151 fixedly support the first rotating shaft 163. The box cover 158 is fixedly connected to the box body 152.

In this embodiment, when the button 154 is not pressed, the button base 153 will block the gear 157. At this time, the wire cord 16 is locked and cannot be elongated, nor can it be automatically retracted. When the button 154 is held, the button base 153 is detached from the gear 157, and at this time, the wire cord 16 can be elongated. With the button 154 held still, when the wire cord 16 is released, the winder 164 will drive the first rotating shaft 163 to retract the wire cord 16 automatically, so as to store the wire cord 16 in the box body 152.

Further, the case lid portion 2 is provided with a face shell 21, a second rotating shaft 291, a bottom board 27, a circular buckle 28, and a transparent board 29. The face shell 21 and the bottom board 27 are fixedly connected. The bottom board 27 is provided with a first rotation hole 270, and the transparent board 29 is provided with a second rotation hole 290. One end of the second rotation shaft 291 is inserted into the first rotation hole 270, and the other end is inserted into the second rotation hole 290. The circular buckle 28 is fixedly installed on the transparent board 29.

In this embodiment, when the boss of the circular buckle 28 is stuck in the groove of the bottom board 27, the transparent board 29 is locked. And when the circular buckle 28 is pushed, the boss of the circular buckle 28 is separated from the groove of the bottom board 27, at this time, the transparent board 29 is opened, and children can put objects in the cavity of the face shell 21 for storage.

Further, the case lid portion 2 is provided with a sliding block 22, a spring 221, a lifting sleeve 23 and a switch board 24. The sliding block 22 is provided with a convex portion 220. The lifting sleeve 23 is provided with a slope 231. When the switch board 24 is dragged, the switch board 24 drives the lifting sleeve 23 to move upward, and the slope 231 drives the sliding block 22 to open to the side. When the switch board 24 is released, the sliding block 22 is pushed to move by the spring 221. The supporting column 13 is provided with a positioning groove 130, and the sliding block 22 is provided with the convex portion 220, which is engaged with the positioning groove 130 in a snap connection.

In this embodiment, when the switch board 24 is pushed upward, it drives the lifting sleeve 23 to move upward, and the slopes 231 will drive the sliding blocks 22 to open to both sides. The positioning groove 130 on the support column 13 will be opened, and the entire face shell 21 can be taken out. When the switch board 24 is released, the rebound force of the spring 221 will resist the sliding block 22, and the convex portion 220 of the sliding block 22 will block the positioning groove 130 on the support column 13. Thus, the entire face shell 21 is locked, that is, the entire luggage case for children is also in a locked state. The support column 13 is provided with a plurality of positioning grooves 130, which can adjust the case lid portion 2 to different heights. When taking an airplane, users can place the luggage case for children in front of the airplane seat, adjust the height of the case lid portion 2 to be flushed with the seat, and lay a cushion to make a bed for a child to sleep onto.

Further, the luggage case for children includes a directional wheel 41, which is fixedly connected to the case body 1. The luggage case for children includes a universal wheel 42, which is fixed connected to the case body 1.

In this embodiment, the luggage case for children can slide more smoothly and turn flexibly through the cooperation of the universal wheel 42 and the directional wheel 41.

Further, the luggage case for children includes an armrest 3, which is fixedly connected to the case lid portion 2.

In this embodiment, when traveling, a child can ride on the luggage case for children, and the child's hands can be held on the armrest 3.

Of course, the present disclosure can also have other various embodiments. Based on this embodiment, those skilled in the art can obtain other embodiments without any creative work, which are within the scope of protection of the present disclosure.

What is claimed is:

1. A luggage case for children, comprising a case body and a case lid portion installed on the case body; wherein, the case body is provided with a first case board, a second case board, a fixing member, a support column, a magnetic buckle, a drawstring set, a wire rope, a plurality of rivets and a metal ring, the first case board fixedly connected to the fixing member through at least one of the rivets, the second case board fixedly connected to the fixing member through at least one of the rivets, at least one of the rivets fixedly connecting the support column to the first case board, at least one of the rivets fixedly connecting the support column to the second case board, the magnetic buckle provided with a base and a drawstring buckle, the base fixedly installed on the first case board, and the wire cord fixedly connected to the metal ring; wherein, when the metal ring is engaged with the drawstring buckle, the luggage case for children is capable of being towed or shoulder-carried by the wire cord; and wherein, the second box board is provided with a clamping slot, and the drawstring set is fixedly installed in the clamping slot.

2. The luggage case for children of claim 1, wherein the drawstring set is provided with a box bracket, a box body, a button base, a button, a box board, a gear, a box cover, a bearing, a first rotating shaft and a winder, the first rotating shaft fixedly connected to the winder, the first rotating shaft fixedly connected to the wire cord, the bearing fixedly installed at both ends of the first rotating shaft, the box bracket fixedly connected to the box body, the gear fixedly installed on the first rotating shaft, the box board fixedly connected to the box body, the box board and the box bracket fixedly supporting the first rotating shaft, and the box cover fixedly connected to the box body.

3. The luggage case for children of claim 1, wherein the case lid portion is provided with a face shell, a second rotating shaft, a bottom board, a circular buckle, and a transparent board, the face shell and the bottom board fixedly connected, the bottom board provided with a first rotation hole, the transparent board provided with a second rotation hole, one end of the second rotation shaft inserted into the first rotation hole while the other end inserted into the second rotation hole, and the circular buckle fixedly installed on the transparent board.

4. The luggage case for children of claim 1, wherein the case lid portion is provided with a sliding block, a spring, a lifting sleeve and a switch board, the sliding block provided with a convex portion, and the lifting sleeve provided with a slope, wherein, when the switch board is dragged, the switch board drives the lifting sleeve to move upward and the slope drives the sliding block to open to the side, and wherein, when the switch board is released, the sliding block is pushed to move by the spring.

5. The luggage case for children of claim 4, wherein the supporting column is provided with a positioning groove, and the sliding block is provided with the convex portion engaged with the positioning groove in a snap connection.

6. The luggage case for children of claim 1 comprising a directional wheel fixedly connected to the case body.

7. The luggage case for children of claim 1 comprising a universal wheel connected to the case body.

8. The luggage case for children of claim 1 comprising an armrest fixedly connected to the case lid portion.

* * * * *